US005248095A

United States Patent [19]

Rankin et al.

[11] Patent Number: 5,248,095

[45] Date of Patent: Sep. 28, 1993

[54] ROTATING NOZZLE

[75] Inventors: George J. Rankin; William A. Lees, both of Houston, Tex.

[73] Assignee: Aqua-Dyne Incorporated, Houston, Tex.

[21] Appl. No.: 738,850

[22] Filed: Jul. 31, 1991

[51] Int. Cl.[5] ..... B05B 3/06

[52] U.S. Cl. ..... 239/261; 239/251; 239/264

[58] Field of Search ..... 239/251, 241, 264

[56] References Cited

U.S. PATENT DOCUMENTS

| | | | |
|---|---|---|---|
| 3,091,400 | 5/1963 | Aubert | 239/251 |
| 4,747,544 | 5/1988 | Kränzle | 239/251 |
| 5,039,013 | 8/1991 | Sawade et al. | 239/261 |
| 5,060,863 | 10/1991 | Hammelmann | 239/251 |

FOREIGN PATENT DOCUMENTS

| | | | |
|---|---|---|---|
| 1139947 | 11/1962 | Fed. Rep. of Germany | 239/251 |
| 3623368 | 9/1987 | Fed. Rep. of Germany | 239/251 |
| 2281177 | 3/1976 | France | 239/251 |
| 2221630 | 2/1990 | United Kingdom | 239/251 |

*Primary Examiner*—Andres Kashnikow
*Assistant Examiner*—Lesley D. Morris
*Attorney, Agent, or Firm*—Alton W. Payne

[57] ABSTRACT

A rotating nozzle for a high pressure water blasting system comprising a rotating body mounted on a fixed shaft having a high pressure water passage therein and adapted to discharge a stream of high velocity water through a nozzle opening in said body that is inclined relative to the longitudinal axis of the rotating body to direct the discharge from the nozzle in a circular path when the body is rotated.

4 Claims, 1 Drawing Sheet

ROTATING NOZZLE

BACKGROUND OF THE INVENTION

Heretofore various arrangements have been tried for using a high velocity water jet for the purpose of cleaning or removing various substances such as grease, paint and the like from surfaces. To accomplish the cleaning operation, a high velocity stream impacts the surface to remove various substances and the effectiveness of such removal depends upon the velocity of the fluid, however, the more discrete the streams, usually the smaller the impact area and as a result the nozzle must be moved about to sweep the surface to the area being cleaned. Nozzles producing a fan-shaped spray have been used to increase the area of contact by the stream and thus reduce the amount of relative movement required to sweep a given area. However, the fan-shaped spray requires a diffusion of high velocity water and typically impacts with less force and velocity than that of the smaller discrete stream.

An object of the present invention is to provide a new and improved nozzle that retains the advantages of the discrete stream but which automatically moves the point of impact of the stream rapidly about so as to sweep a larger area than simply that of the discrete stream but without the disadvantage of diffusing the stream and thereby reducing the impact velocity of the fluid.

Another object is to provide a rotating nozzle which is mounted for rotation about a fixed hollow shaft from which a high velocity stream of water is discharged through the rotating nozzle. The rotating nozzle is inclined with respect to the high velocity stream and causes it to change direction. Due to the relatively high velocity of the stream as it enters the inclined nozzle it has relatively low pressure and thus no seal is required between the discharge end of the hollow shaft and the rotating nozzle.

And yet another object of the present invention is to provide a rotating nozzle which will direct a discrete stream in a generally circular pattern to rapidly sweep a generally circular path and continuously move the point of impact of the stream without having to move the nozzle about. With the high speed rotation of the nozzle of the present invention, the discrete stream is constantly moving in a looping circular path quickly covers a large area with a minimum of manual movement of the high pressure gun by the operator.

DESCRIPTION OF THE PREFERRED EMBODIMENT

Figure 2:
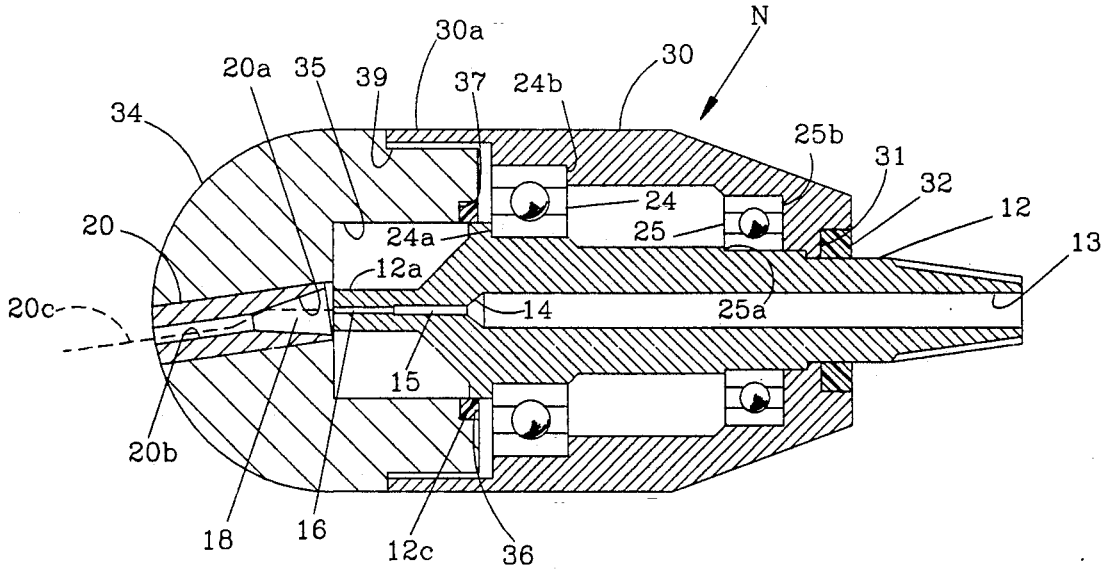
FIG. 2 is a longitudinally extending cross-sectional view of the nozzle showing details of construction.

As shown in FIG. 2, the rotating nozzle N of the present invention includes a fixed shaft 12 having a longitudinally extending passage 13 extending therethrough with the outer end of the shaft being adapted for connection to a high pressure gun or pipe (not shown) for receiving high pressure water. The opposite end or inner end of the longitudinally extending passage 13 communicates with an intermediate chamber formed by a truncated cone 14 that terminates in a reduced diameter passage 15 which is then connected to a smaller diameter discharge passage or nozzle 16.

High pressure water pumped through the passage 13 and out through the small diameter passage 16 forms a small high velocity stream indicated at 18 which impinges on the nozzle insert 20 carried by the rotatable portion of the nozzle N.

Also as shown in FIG. 2 of the drawings, the nozzle N is rotatably mounted on the shaft 12 by means of longitudinally spaced bearings 24 and 25 which are mounted adjacent annular shoulders **24*a* and 25*a* formed on the shaft 12. The bearings 24 and 25 are also secured with respect to the rotating outer housing or body 30 by means of annular shoulders 24*b* and 25*b*, respectively. The inboard end of the housing 30 includes a groove 31 which carries a rear wiper seal 32 that surrounds the shaft 12**.

The forward end of the rotating nozzle N includes a dome or rounded shaped head 34 which has an opening 35 that receives the small diameter end portion **12*a* of the shaft 12. As shown, forward wiper seal 36 is carried by the rotating head 34 in a groove 37 and is positioned internally near the end of the opening 35 so as to engage the forward shoulder 12*c* of the shaft 12. Further, the head 34 is provided with a recessed band at 39 for receiving the forwardly extending sleeve portion 30*a* of the housing 30**.

The nozzle insert 20 carried in the rotating head 34 is inclined at an angle with respect to the longitudinal axis of the passage 13 as well as the discharge passage 16 and the stream of high velocity water 18. The nozzle insert 20 is provided with a tapered interior bore **20*a* and a straight wall bore 20*b* with the tapered portion 20*a* being tapered downwardly and inwardly from the inlet end adjacent the small diameter nozzle 16 and the straight wall portion 20*b* being adjacent the outer end of the nozzle insert 20**.

Figure 1:
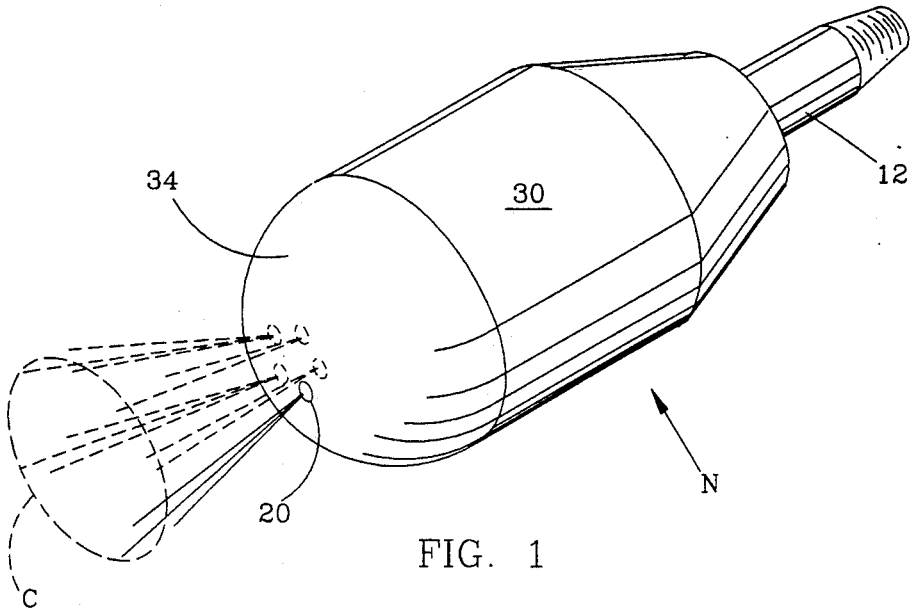
FIG. 1 is an isometric view of the rotating nozzle and a schematic representation of the spray pattern generated by operation of the nozzle.

As shown in the drawing, the small stream of high velocity water 18 impinges against the tapered portion **20*a* of the nozzle 20 and, the large diameter end of the tapered portion 20*a* is positioned so as to surround the passage 16 throughout a full revolution of the rotatable head 34. Thus, it will be appreciated that with the apparatus of this invention, the high velocity stream 18 has relatively low pressure and that no seal is required between the small diameter end portion 12*a* of the hollow shaft 12 and nozzle insert 20. The high velocity stream 18 passing through the nozzle insert 20 will be deflected and directed in the direction generally of the axis of that nozzle insert indicated at 20*c* and that the force of the high velocity stream impinging upon the tapered portion 20*a* of the nozzle will create a reaction force causing the nozzle insert 20 as well as the housing or end portion 34 and the shell 30 to rotate on the shaft 12 and the deflected stream following generally the axis 20*c* will describe a circular pattern C as shown in FIG. 1 as the head 34 is rotated. Of course, it will also be appreciated that manual guidance of the apparatus in a lateral direction would cause the stream to describe a series of loops rather than a circle in that with the apparatus of this invention the high speed rotation of the nozzle will rapidly describe a series of close circles and as the nozzle is moved laterally the effect of the high pressure stream will be to describe a sweeping motion with the benefit of the small diameter discrete stream striking each point along the path described by the stream. Further, it will be understood that as the rotating head is moved about manually, the actual pattern described by the impact path of the stream will be a function of the pattern of movement of the head plus whatever rotary movement occurs to the member 34**. This pattern may be described as a series of continuous loops closely spaced together to provide substantially complete coverage of the work surface. Of course, the head can be moved manually from side to side or back and forth to increase the saturation of coverage on the workpiece.

Having described the invention above, various modifications of the techniques, procedures, material and equipment will be apparent to those in the art. It is intended that all such variations within the scope and spirit of the appended claims be embraced thereby.

We claim:

1. A rotating nozzle for use in cleaning or removing substances from surfaces, including:

(a) a fixed shaft having a longitudinally extending passage therethrough, narrowing in the outlet direction, with one end adapted to be connected to a source of high pressure fluid and a first discharge passage at the opposite end of the longitudinally extending passage for discharging a stream of high velocity fluid therefrom;

(b) a rotating head mounted on said fixed shaft and adapted to be rotated about the longitudinal axis of said first discharge passage; and (c) a second discharge passage in said rotating head, narrowing in the outlet direction and disposed at an angle with respect to said first discharge passage in said fixed shaft and adapted to intersect at least a portion of the high velocity stream discharged therefrom to cause the rotating head to rotate relative to said fixed shaft;

wherein said second discharge passage comprises a tapered interior bore and a straight wall bore; wherein said tapered interior bore has a large diameter end and a small diameter end and said large diameter end extends around said first discharge passage when said rotating head is being rotated by a high pressure stream discharged from said first discharge passage and said tapered interior bore is tapered downwardly and inwardly from said first discharge passage and communicates fluid to said straight wall bore.

2. The invention as defined in claim 1 wherein said rotating head has an aperture, slightly off-center of the pinnacle of the discharge end, which forms a circular pattern to rapidly sweep a generally circular path.

3. The invention of claim 1 wherein the rotating head automatically moves the point of impact of the stream exiting said bore rapidly about so as to sweep a larger area than if the stream engaged the surface in a perpendicular manner.

4. A rotating nozzle for use in cleaning or removing substances from surfaces using a fluid comprising:

(a) a fixed shaft having a first end and a second end with a longitudinal passage therethrough, the passage at the first end being larger than the passage at the second end whereby the passage has an unobstructed longitudinal axis, and (b) an exposed, rounded rotating head being attached to said shaft and having a concentric channel wherein said channel has an axis parallel and concentric to the longitudinal axis of said shaft and is adapted for concentrically accepting said second end of said shaft wherein said channel has a bore at the opposite end which bore has a longitudinal axis offset from the longitudinal axis of the passage of said shaft, such that the fluid ingresses the passage at the first end of said shaft and egresses the passage at the second end of said shaft into said concentric channel of said rotating head for engaging the bore of said rotating head for rotating said head about said shaft whereby the fluid egressing the bore in said rotating head will have a circular pattern.

* * * * *